United States Patent [19]

Vilchek, deceased et al.

[11] Patent Number: 4,512,438

[45] Date of Patent: Apr. 23, 1985

[54] ESCAPE APPARATUS

[76] Inventors: Andrew Vilchek, deceased, late of Palos Park, Ill.; by Mary F. Trindl, executrix, 12612 Pawnee Rd., Palos Park, Ill. 60464

[21] Appl. No.: 574,913

[22] Filed: Jan. 30, 1984

[51] Int. Cl.[3] ..... A62B 1/12

[52] U.S. Cl. ..... 182/43; 182/3; 182/238

[58] Field of Search ..... 182/42, 43, 44, 3, 5 ∝ 8, 182/238; 187/6

[56] References Cited

U.S. PATENT DOCUMENTS

| | | | |
|---|---|---|---|
| 278,858 | 6/1883 | Bills . | |
| 290,961 | 12/1883 | Bixby . | |
| 299,511 | 6/1884 | Blessing . | |
| 448,176 | 3/1891 | Bullard | 182/42 |
| 473,572 | 4/1892 | Gunnarson . | |
| 481,252 | 8/1892 | Brainard . | |
| 489,463 | 1/1893 | Coker . | |
| 553,299 | 1/1896 | Campbell . | |
| 619,105 | 2/1899 | Watson et al. . | |
| 640,099 | 12/1899 | Cotter | 182/43 |
| 816,495 | 3/1906 | Moore | 182/3 |
| 1,069,325 | 8/1913 | Elsner . | |
| 1,202,571 | 10/1916 | Olsen . | |
| 1,206,676 | 11/1916 | Cote . | |
| 1,576,210 | 3/1926 | Nickson | 182/5 |
| 2,543,348 | 2/1951 | Briese . | |
| 2,549,707 | 4/1951 | Plummer . | |
| 2,647,675 | 8/1953 | Bernett . | |
| 2,873,055 | 11/1955 | Hill . | |
| 3,018,842 | 1/1962 | Abrell | 182/43 |
| 3,207,263 | 9/1965 | Cull . | |
| 3,261,590 | 7/1966 | Bech | 182/238 |
| 3,325,147 | 6/1967 | Carlson et al. . | |
| 3,908,791 | 9/1975 | Kleine | 182/8 |
| 3,915,432 | 10/1975 | Bustamante . | |
| 3,944,021 | 3/1976 | Smith, Jr. et al. . | |
| 3,946,836 | 3/1976 | Maack . | |
| 4,026,385 | 5/1977 | Murukurthy . | |
| 4,121,689 | 10/1978 | Bonvin . | |
| 4,191,275 | 3/1980 | Mansfield, Jr. . | |
| 4,406,349 | 9/1983 | Vilchek . | |

FOREIGN PATENT DOCUMENTS

| | | | |
|---|---|---|---|
| 2306110 | 2/1973 | Fed. Rep. of Germany | 182/238 |

*Primary Examiner*—Reinaldo P. Machado

*Attorney, Agent, or Firm*—Willian Brinks Olds Hofer Gilson & Lione Ltd.

[57] ABSTRACT

An escape apparatus for lowering persons down a structure includes an upper pulley and a lower pulley, both of which are secured to the structure. An endless loop cable passes around the pulleys such that movement of the cable causes the lower pulley to rotate. A hydraulic speed control system is provided which includes a hydraulic reservoir containing hydraulic fluid, a hydraulic pump, and conduits for interconnecting the pump and the reservoir such that the pump removes hydraulic fluid from the reservoir and returns the fluid under pressure to the reservoir. The output of the pump is restricted by means of a valve, and the pump is driven by the lower pulley such that downward movement of the cable causes the lower pulley to rotate and therefore the pump to force fluid through the restricting valve. This flow restriction of hydraulic fluid pumped by the pump limits the speed of the pump and thereby the speed of the cable. A friction clamp for supporting a person on the cable is disclosed.

11 Claims, 6 Drawing Figures

ESCAPE APPARATUS

BACKGROUND OF THE INVENTION

This invention relates to an improved system for safely, reliably and automatically transporting persons down from an elevated structure, and in particular to such a system as adapted for use in a fire escape system.

It has long been recognized that a fire escape system which allows persons to be lowered on the outside of a building provides important safety advantages. For example, Blessing U.S. Pat. No. 299,511 and Bixby U.S. Pat. No. 290,961 disclose endless loop ladders mounted to the exterior of a building to serve as fire escapes. The downward movement of the ladders under the weight of individuals on the ladders is limited by friction brakes.

Similarly, Elsner U.S. Pat. No. 1,069,325 discloses an endless loop strap mounted to the exterior of a building. This strap is provided with openings spaced along its length, and a user clips a sling to the openings in order to secure himself to the strap. Once again, friction brakes are used to limit the velocity of the belt.

Cote U.S. Pat. No. 1,206,676, Hill U.S. Pat. No. 2,873,055, and Carlson U.S. Pat. No. 3,325,147 all disclose cable or strap type winding devices for use as fire escapes. The Coat patent discloses the use of a centrifugal friction brake; the Carlson patent discloses the use of a manually operated friction brake; and the Hill patent discloses the use of a hydraulically actuated friction brake. In the Hill patent a positive displacement pump is used to generate a control pressure which varies as a function of the cable speed. This control pressure then actuates a friction brake.

Another approach is disclosed in my previous U.S. Pat. No. 4,402,349 which utilizes a gear track mounted to the side of a building to insure positive engagement between the building and a carriage used to lower individuals to ground level.

SUMMARY OF THE INVENTION

The present invention is directed to an improved escape apparatus which is remarkably simple, effective and reliable in operation.

The escape apparatus of this invention includes an upper pulley and a lower pulley, both of which are secured to a structure. An endless loop cable is passed around the two pulleys such that movement of the cable causes at least a first one of the pulleys to rotate. Means are provided for supporting a person on the cable, along with means for retarding rotation of the first pulley to limit the rate of movement of the cable.

According to a first feature of this invention, the means for retarding rotation of the pulley comprises a hydraulic reservoir containing a hydraulic fluid, a hydraulic pump, and conduit means for interconnecting the pump and the reservoir such that the pump removes hydraulic fluid from the reservoir and returns the fluid under pressure to the reservoir. Restricting means restrict the flow of hydraulic fluid in the conduit means from the pump to the reservoir, and the pump is driven by the first pulley. This arrangement of elements insures that movement of the cable causes the first pulley to rotate and therefore the pump to force fluid through the restricting means. The flow restriction limits the speed of the pump and thereby the speed of the cable.

The hydraulic speed limiting device of this invention does not rely on conventional friction brake materials.

Rather, it is the restriction of the output of the pump which provides the desired limitation on the speed of the cable.

According to a second feature of this invention, the means for supporting a person on the cable comprises a friction clamp which includes a clamp bracket which defines a bight section sized to receive the cable. A clamp plate is pivotably mounted to the clamp bracket and defines a clamping surface and a lever arm. The clamp plate is movable between an open position, in which the cable may be inserted into and removed from the bight section of the bracket, and a closed position, in which the clamping surface captures the cable against the bight section and frictionally engages the cable.

In the preferred embodiment described below a harness is secured to the lever arm of the clamp plate and this harness is sized to support a person. Downward forces applied to the harness hold the clamp plate in a closed position in order to prevent slipping between the cable and the clamp when a person is supported on the cable by the clamp and the harness.

This feature of the invention allows an individual to secure himself to the cable in a particularly simple, reliable and effective manner. The clamp can be positioned at any desired point along the length of the cable, and thus the individual does not have to seek out and find specialized portions of the cable. Furthermore, the friction clamp described below can simply, easily and quickly be removed from the cable after the individual has reached the level of the lower pulley.

The invention itself, together with further objects and attendant advantages, will best be understood by reference to the following detailed description, taken in conjunction with the accompanying drawings.

DETAILED DESCRIPTION OF THE PRESENTLY PREFERRED EMBODIMENTS

Figure 1:
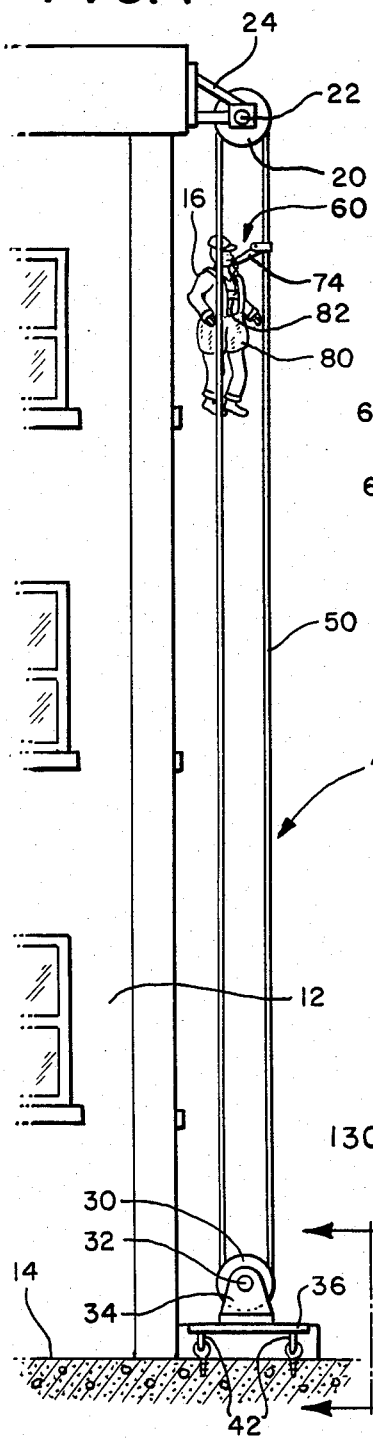
FIG. 1 is a side elevational view of a first preferred embodiment of this invention.

Turning now to the drawings, the reference numeral 10 is used to refer generally to a first preferred embodiment of this invention. This embodiment 10 is mounted to a vertical structure 12, such as an outside wall of a building for example. Portions of the embodiment 10 are mounted to a concrete slab 14 at ground level, and the embodiment 10 operates to lower individuals such as the individual 16 alongside the structure 12.

As shown in FIG. 1, the embodiment 10 includes an upper pulley 20 which is mounted for rotation about a horizontal axis 22 by means of a support bracket 24. In this embodiment, the upper pulley 20 is free to rotate without restriction about the axis 22.

Figure 2:
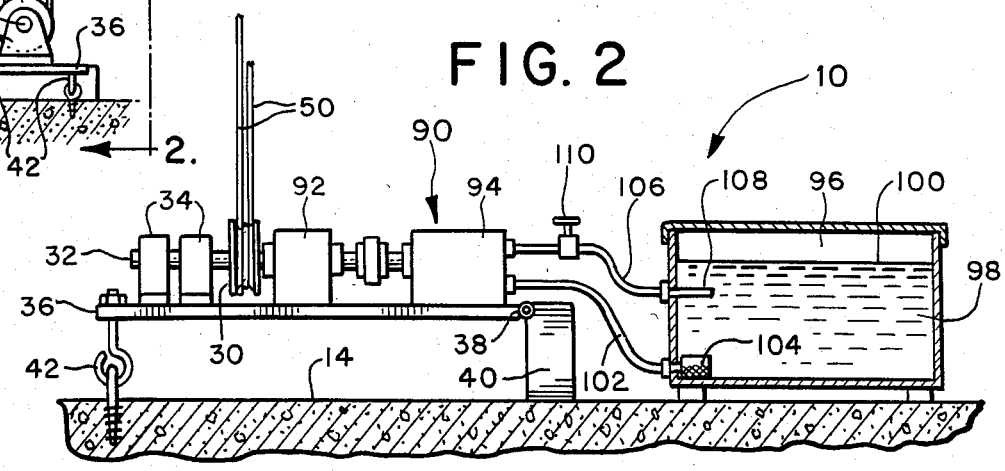
FIG. 2 is a front elevational view taken along line 2—2 of FIG. 1 showing a lower portion of the embodiment of FIG. 1.

As shown in FIGS. 1 and 2, the embodiment 10 also includes a lower pulley 30 which is mounted for rotation by means of a shaft 32 which is supported in bearings 34. These bearings 34 are in turn mounted on a substantially horizontal platform 36. The platform 36 is mounted at one end to a support 40 by means of a horizontally oriented hinge 38. A plurality of hold-down bolts 42 extend between the free end of the platform 36 and the slab 14. The angle of the platform 36 about the hinge 38, and therefore the vertical position of the lower pulley 30, can be adjusted by means of the hold-down bolts 42.

An endless loop cable 50 is positioned around the upper pulley 20 and the lower pulley 30. In this preferred embodiment the lower pulley 30 is a V pulley and the cable 50 is wrapped around the lower pulley 30 twice. This is done to insure that movement of the cable 50 results in rotation of the lower pulley 30.

Figure 3:
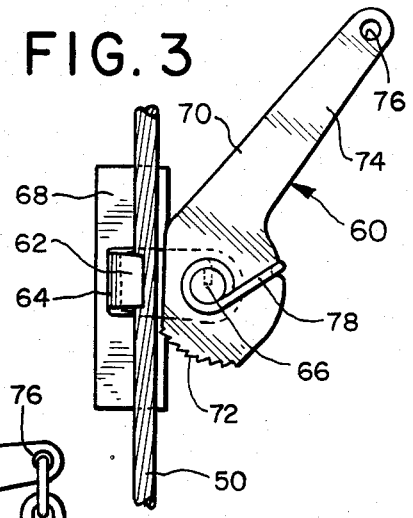
FIG. 3 is an elevational view showing the friction clamp of the embodiment of FIG. 1 in an open position.
Figure 4:
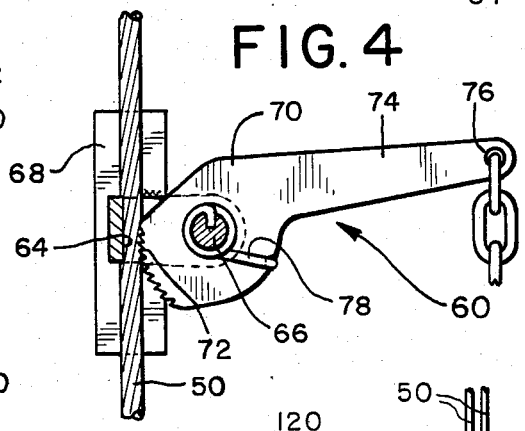
FIG. 4 is a view corresponding to that of FIG. 3 showing the friction clamp of FIG. 3 in the closed position.

FIGS. 3 and 4 provide two views of a friction clamp 60 which is used to secure the individual 16 to the cable 50. In FIG. 3, the friction clamp 60 is shown in an open position, and in FIG. 4 the clamp 60 is shown in a closed position.

The clamp 60 includes a clamp bracket 62 which defines a bight section 64. The bight section 64 is in this preferred embodiment U-shaped in cross section. The clamp bracket 62 also defines a pivot axis 66. A backplate 68 is secured to the clamp bracket 62, as for example by welding. As shown in FIGS. 1 and 2, when the clamp 60 is secured to the cable 50, the backplate 68 extends alongside of and parallel to the cable 50.

The clamp 60 also includes a clamping plate 70 which is pivotably connected to the clamp bracket 62 at the pivot axis 66. The clamping plate 70 defines a clamping surface 72 which in this preferred embodiment is notched or serrated. A lever arm 74 extends away from the pivot axis 66, and is disposed on the opposite side of the pivot axis 66 from the clamping surface 72. An opening 76 is provided at the end of the lever arm 74. A spring 78 is positioned around the pivot axis 66 so as to bias the clamping plate 70 into the closed position shown in FIG. 4.

As best shown in FIG. 1, a harness 80 is provided which is sized to receive and support an individual. This harness 80 is supported at an attachment point 82 by the lever arm 74. In particular, the harness 80 is secured at the opening 76.

As shown in FIG. 3, the clamp 60 can readily be installed on the cable 50 by moving the clamping plate 70 to the open position of FIG. 3. Then the clamp 60 is positioned with the cable 50 within the bight section 64, and the clamping plate 70 is released. The spring 78 then moves the clamping plate 70 to the closed position shown in FIG. 4. In this closed position, the clamping surface 72 frictionally engages the cable 50. In addition, the clamping surface 72 substantially fills the open area of the bight section 64, thereby positively capturing the cable 50 in place within the bight section 64. Downward forces applied to the lever arm 74 serve to increase the frictional hold of the clamp 60 on the cable 50.

As shown in FIG. 2, the embodiment 10 includes a speed limiting system 90 which limits the speed of rotation of the lower pulley 30. This speed limiting system 90 includes a gear reducer 92 which is coupled between the lower pulley 30 and a positive displacement gear pump 94. In this embodiment, the gear reducer 92 is positioned to ensure that the gear pump 94 is driven at a higher angular velocity than that of the lower pulley 30. As shown in FIG. 2, the gear reducer 92 and the gear pump 94 are both mounted on the platform 36.

The speed limiting system 90 also includes a hydraulic reservoir 96 which contains a hydraulic fluid 98. In FIG. 2 the reference numeral 100 is used to indicate the upper surface of the hydraulic fluid 98. A first hydraulic conduit 102 carries hydraulic fluid from a lower portion of the reservoir 96 to the gear pump 94. A screen 104 is positioned around the inlet to the first conduit 102 in order to prevent sediment from entering the gear pump 94 via the first conduit 102. A second conduit 106 carries pressurized hydraulic fluid from the gear pump 94 back to the reservoir 96. This second conduit 106 terminates in an outlet 108 which in this preferred embodiment is positioned two or three inches below the upper surface 100 of the hydraulic fluid 98.

The gear pump 94, which is coupled via the gear reducer 92 to the lower pulley 30, pumps hydraulic fluid 98 from the reservoir 96 via the conduits 102, 106 back to the reservoir 96. In this embodiment it is preferred to have the outlet 108 of the second conduit 106 below the upper surface 100 of the hydraulic fluid 98 in order to reduce aeration and frothing of the hydraulic fluid 98.

A valve 110 is positioned in the second conduit 106 in order to restrict the flow of pressurized hydraulic fluid from the gear pump 94 back to the reservoir 96. In this preferred embodiment the valve 110 defines an orifice which can be closed to a variable extent by a needle point valve. By adjusting the valve 110 the flow restriction in the second conduit 106 can be adjusted as desired. A greater flow restriction imposes a greater load on the gear pump 94 for a given pump speed. Thus, by adjusting the valve 110 the load on the gear pump 94 and therefore the speed of the lower pulley 30 can be adjusted.

Figure 5:
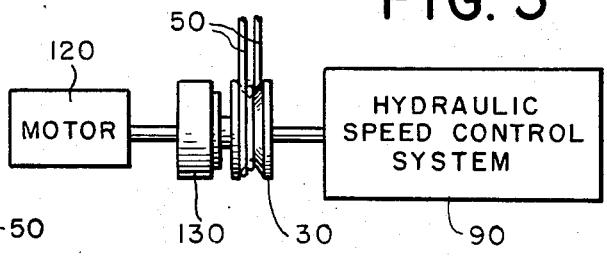
FIG. 5 is a schematic representation of portions of a second preferred embodiment of this invention.
Figure 6:
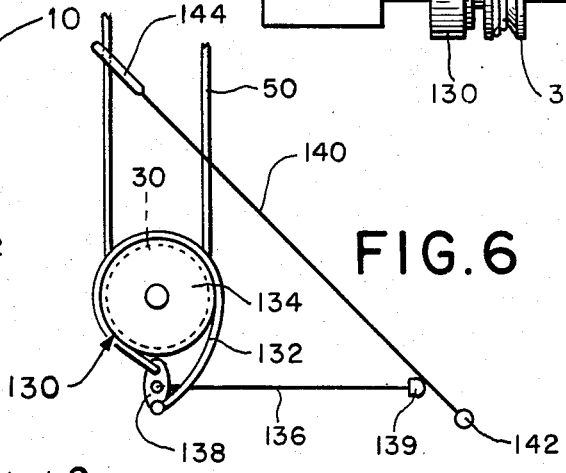
FIG. 6 is a side view taken along line 6—6 of FIG. 5.

FIGS. 5 and 6 illustrate the lower portions of a second preferred embodiment of this invention. This second preferred embodiment includes a lower pulley 30 and a hydraulic speed control system 90 identical to those described above. The embodiment of FIGS. 5 and 6 also includes a motor 120 which is coupled to rotate the lower pulley 30. This motor 120 can be a battery powered electric motor or a gasoline engine, for example. In either case, the motor 120 can be used to rotate the lower pulley 30 in order to lift persons or objects secured to the cable 50, as for example when it is desired to raise firemen to upper floors of a building.

In addition, the embodiment of FIGS. 5 and 6 includes a friction brake 130 which includes a friction brake band 132 and brake drum 134. The brake drum 134 rotates in unison with the lower pulley 30. The position of the brake band 132 is controlled by a first lever 136 which pivots about an axis 138. The free end 139 of this first lever 136 makes sliding contact with a second lever 140. This second lever 140 pivots about an axis 142 and defines a loop 144 at its free end. This loop 144 is positioned around the downwardly moving portion of the cable 50. When the individual 16 supported on the cable 50 by the friction clamp 60 approaches ground level, the friction clamp 60 bears on the loop 144 of the second lever 140. The weight of the individual 16 supported by the clamp 60 causes the second lever 140 to pivot downwardly as shown in FIG. 6 about the axis 142. This pivoting action causes the first lever 136 to pivot clockwise as shown in FIG. 6, thereby tightening the brake band 132 against the brake drum 134 and further slowing the rotation of the lower pulley 30. In this way, the speed of descent of the individual supported by the clamp 60 is further reduced just prior to the time the individual reaches ground level.

Having described two preferred embodiments of this invention, its operation can now be discussed in detail.

The escape devices illustrated in FIGS. 1 through 4 and 5 through 6 are preferably mounted alongside the outside wall of a building. In order to make use of this escape apparatus an individual in an upper floor of the building puts on the harness 80, which may for example be formed of a webbing similar to that used for parachute harnesses. The harness 80 is securely connected to the lever arm 74 of the clamp 60. The individual then reaches out to the downwardly moving side of the cable 50, opens the clamp 60 to the position shown in FIG. 3, and inserts the cable 50 in the clamp 60. He then allows the clamp 60 to close to the position shown in FIG. 4 and places his weight on the clamp 60 and the cable 50. This can be done for example by climbing over a balcony railing situated adjacent to the cable 50.

Once the individual's weight is supported by the cable 50, the speed limiting system 90 operates automatically without use of friction brakes to limit the rotational speed of the lower pulley 30 and therefore the rate of descent of the individual 16 supported on the cable 50. In this regard, it should be understood that the load imposed by the flow restriction of the valve 110 increases with increasing speed of the gear pump 94. For this reason, the speed limiting system 90 lowers a heavy person 16 at an only slightly faster rate than that of a lighter person. Preferably, the valve 110 should be adjusted to provide a speed of descent for the person 16 in the range of 4 to 8 feet per second.

Once the individual 16 reaches ground level, he can readily remove the clamp 60 from the cable 50 in order to allow the system to be used by other people. If desired, the clamp 60 can be repositioned on the opposite side of the cable 50 in order to raise the clamp 60 with its attached harness 80 for reuse. Furthermore, if multiple people are descending on one side of the cable 50, a smaller number of firemen can automatically be raised to a higher level by positioning one of the clamps 60 on the opposite side of the cable 50. Of course, when the second preferred embodiment of FIGS. 5 through 6 is used, the motor 120 can be used to raise persons or objects.

Merely by way of example and not limitation, the embodiment 10 is provided with pulleys 20, 30 which are six inches in diameter. In this preferred embodiment the cable 50 is three-eighths inch in diameter and is formed of a plastic coated steel. The gear reducer 92 is in this preferred embodiment a 24 to 1 gear reducer such as that marketed by Dayton as Model No. 27821A. The pump 94 of this embodiment is preferably a positive displacement gear pump such as Model # OLE distributed by Tuthill Industrial Pump.

In this embodiment, the clamp bracket 62 and clamping plate 70 are formed of three-eighths inch steel plate, the backplate 68 is approximately seven inches in length and the bight section 64 is approximately two and one-half inches in length along the length of the cable 50. The conduits 102, 106 can be formed of one-half inch rubber hydraulic hose or copper tube. Any suitable hydraulic fluid may be used, such as hydraulic oil for example. If freezing temperatures are not anticipated, water may be suitable in some embodiments. The restricting means in the second conduit 106 may be either variable or fixed depending upon the application. Furthermore, if the gear pump 94 is properly dimensioned, the gear reducer 92 may be eliminated in some embodiments. The cross-sectional shape of the cable 50 is not critical, and the present invention is not limited to use with buildings as a fire escape device. To the contrary, this invention can find wide application in other settings such as mine safety applications. The speed limiting system 90 and the motor 120 may be positioned to cooperate with either the upper pulley 20 or the lower pulley 30, depending upon the particular application. If desired, a manual hand control can be provided for the brake 130 in order to allow an individual at ground level to control the rate of descent of the cable 50. Of course, other brakes such as centrifugal, disc or magnetic brakes may be substituted for the drum brake 130.

In an alternate embodiment (not illustrated) the brake 130 is actuated by a platform. This platform is positioned such so that an individual descending on the cable 50 is supported by the platform when he reaches ground level. It is the weight of the individual on the platform which actuates the brake 130.

Of course, it should be understood that a wide range of changes and modifications to the preferred embodiments described above will be apparent to those skilled in the art. It is therefore intended that the foregoing detailed description be regarded as illustrative rather than limiting, and that it be understood that it is the following claims, including all equivalents, which are intended to define the scope of this invention.

I claim:

1. An escape apparatus for lowering persons down a structure comprising:

a base pivotably mounted adjacent to the structure to pivot in a vertical plane;

a lower pulley rotably mounted to the base;

an upper pulley secured to the structure in vertical alignment with the lower pulley;

an endless loop cable mounted to pass around the upper and lower pulley such that movement of the cable causes at least the first pulley to rotate;

adjusting means mounted to the base to adjust the vertical position of the base in opposition to tension of the cable on the first pulley in order to adjust the tension of the cable;

means for supporting a person on the cable;

a hydraulic reservoir containing a hydraulic fluid;

a hydraulic pump;

conduit means for interconnecting the pump and the reservoir such that the pump removes hydraulic fluid from the reservoir and returns the fluid under pressure to the reservoir;

restricting means for restricting the flow of hydraulic fluid in the conduit means from the pump to the reservoir;

means for coupling the pump to the first pulley such that movement of the cable causes the first pulley to rotate and the pump to force fluid through the restricting means, and the flow restriction of hydraulic fluid pumped by the pump limits the speed of the pump and thereby the speed of the cable; and auxillary brake means coupled to the first pulley for slowing rotation of the first pulley by an additional amount when a person supported on the cable by the support means approaches the first pulley.

2. The invention of claim 1 wherein the pump comprises a positive displacement pump.

3. The invention of claim 1 wherein the coupling means comprises a speed reduction unit operated such that the pump is driven at a higher speed than that of the first pulley.

4. The invention of claim 1 wherein the first pulley is the lower pulley.

5. The invention of claim 1 wherein the hydraulic fluid defines an upper surface in the reservoir, and wherein the conduit means returns fluid under pressure to the reservoir at a level beneath the upper surface to minimize aeration of the hydraulic fluid.

6. The invention of claim 1 wherein the supporting means comprises a friction clamp comprising:

a clamp bracket which defines a bight section sized to receive the cable;

a clamp plate pivotably mounted to the clamp bracket and defining a clamping surface and a lever arm, said clamp plate movable between an open position in which the cable may be inserted into and removed from the bight section, and a closed position in which the clamping surface captures the cable against the bight section and frictionally engages the cable.

7. The invention of claim 6 wherein the supporting means further comprises:

a support harness secured to the lever arm of the clamp plate such that downward forces applied to the support harness hold the clamp plate in the closed position in order to prevent slipping between the cable and the clamp when a person is supported on the cable by the clamp and the harness.

8. The invention of claim 1 further comprising:

a motor coupled to the first pulley to drive the pulley in a selected direction.

9. An escape apparatus for lowering persons down a structure comprising:

an upper pulley secured to the structure;

a base pivotably mounted adjacent the structure to pivot in a vertical plane;

a lower pulley secured to the base below the upper pulley;

an endless loop cable mounted to pass around the upper and lower pulleys such that movement of the pulley causes the lower pulley to rotate;

adjusting means mounted to the base to adjust the vertical position of the base in opposition to tension of the cable on the lower pulley in order to adjust the tension of the cable;

means for supporting a person on the cable, said supporting means comprising:

a harness sized to fit around a person;

a friction clamp which comprises a bracket defines a pivot axis and a U-shaped bight section sized to receive the cable;

a clamp plate mounted to the bracket to pivot about the pivot axis, said clamp plate defining a serrated clamp surface on one side of the pivot axis and a lever arm on the other side of the pivot axis, said clamp plate pivotable about the pivot axis between an open position, in which the cable may be inserted in and removed from the bight section, and a closed position, in which the clamp surface positively captures the cable in the bight section and frictionally engages the cable in the bight section; and means for connecting the harness to the lever arm such that downward forces on the harness hold the clamp plate in the closed position;

means for retarding rotation of the lower pulley to limit the rate of movement of the cable, said retarding means comprising:

a reservoir which contains a hydraulic fluid which defines an upper surface;

a positive displacement pump driven by the lower pulley;

a first conduit which supplies hydraulic fluid from the reservoir to the pump;

a second conduit which returns pressurized hydraulic fluid from the pump to the reservoir at a point below the upper surface of the hydraulic fluid; and an orifice in the second conduit sized to restrict the flow of hydraulic fluid from the pump to the reservoir.

10. The invention of claim 9 further comprising:

a motor coupled to the lower pulley to drive the pulley in a selected direction.

11. The invention of claim 9 further comprising:

brake means for slowing rotation of the lower pulley by an additional amount when a person supported on the cable by the support means approaches the lower pulley.

* * * * *